US010806651B2

(12) United States Patent
Hanley

(10) Patent No.: US 10,806,651 B2
(45) Date of Patent: Oct. 20, 2020

(54) SYSTEMS AND METHODS RELATED TO WHEELCHAIR CONVENIENCE AND/OR SAFETY

(71) Applicant: EasyWheelz, LLC, Lake Geneva, WI (US)

(72) Inventor: Michael K. Hanley, Lake Geneva, WI (US)

(73) Assignees: Michael K. Hanley, Lake Geneva, WI (US); Easywheelz, LLC, Lake Geneva, WI (US)

( * ) Notice: Subject to any disclaimer, the term of this patent is extended or adjusted under 35 U.S.C. 154(b) by 0 days.

(21) Appl. No.: 16/128,077

(22) Filed: Sep. 11, 2018

(65) Prior Publication Data

US 2019/0201259 A1 Jul. 4, 2019

Related U.S. Application Data

(60) Provisional application No. 62/613,565, filed on Jan. 4, 2018.

(51) Int. Cl.
*A61G 5/12* (2006.01)
*A61G 5/10* (2006.01)

(52) U.S. Cl.
CPC ..... *A61G 5/128* (2016.11); *A61G 5/1051* (2016.11)

(58) Field of Classification Search
CPC ..... A61G 5/12; A61G 5/128
See application file for complete search history.

(56) References Cited

U.S. PATENT DOCUMENTS

| | | | | | |
|---|---|---|---|---|---|
| 4,033,624 | A * | 7/1977 | Jun | A61G 5/12 | 297/423.3 |
| 4,988,114 | A * | 1/1991 | Thornton, Jr. | A61G 5/12 | 280/304.1 |
| 5,401,045 | A * | 3/1995 | Foerster | A61G 5/12 | 280/250.1 |
| 6,338,493 | B1 * | 1/2002 | Wohlgemuth | A61G 5/00 | 135/66 |
| 6,422,653 | B1 * | 7/2002 | Szczepanski | A61G 5/12 | 280/291 |
| 6,880,845 | B1 * | 4/2005 | Broyles | A61G 5/12 | 280/250.1 |
| 9,474,666 | B1 * | 10/2016 | Smith | A61G 5/10 | |
| 2005/0098695 | A1 * | 5/2005 | Hollenbeck | A61H 3/0244 | 248/229.26 |
| 2008/0001461 | A1 * | 1/2008 | Fujihara | A61G 5/12 | 297/423.35 |
| 2013/0264796 | A1 * | 10/2013 | MacPherson | A61G 5/12 | 280/291 |
| 2013/0292988 | A1 * | 11/2013 | Jeyasurya | A61G 5/14 | 297/423.26 |
| 2016/0220432 | A1 * | 8/2016 | Ooyama | A61G 5/1021 | |

* cited by examiner

*Primary Examiner* — Brian L Swenson

(57) ABSTRACT

Wheelchair convenience systems including a removably attachable footrest that has a biased footrest platform and a lever for moving the footrest platform from a first position to a second position. The invention also includes a cane retainer that positions a cane between a first and a second handgrip of the wheelchair and allow the cane to be used as a handlebar to more easily maneuver the wheelchair.

14 Claims, 10 Drawing Sheets

SYSTEMS AND METHODS RELATED TO WHEELCHAIR CONVENIENCE AND/OR SAFETY

RELATED APPLICATIONS

This application claims the benefit of U.S. provisional patent application Ser. No. 62/613,565, filed Jan. 4, 2018, which is incorporated herein by reference in its entirety.

BACKGROUND

Generally, wheelchair occupants are persons that may have difficulty walking, standing, or supporting their bodies in an upright position for one reason or another, which may include impairment of hip flexors, such as the iliopsoas. Most wheelchairs are equipped with a pair of leg extensions having footrest platforms configured to support the feet and/or legs of the wheelchair occupant. The footrest platforms are generally designed to rotate about the ends of the leg extensions and are operable through an approximately 90-degree pivot range by manipulating the platform manually by hand by grasping and moving it through a range of motion. Manual manipulation of wheelchair footrest platforms makes it difficult for a person to get in and out of the wheelchair, as the platforms are difficult to reach for either the wheelchair occupant or an assistant. As a result, wheelchair occupants are often not able to stand up or lift themselves out of the wheelchair without assistance because they are not able to raise or lower the footrests by themselves.

The footrest platforms are also difficult for caregivers to reach because they must bend over almost to the floor to reach them. The platforms are usually disposed approximately five to eight inches above a horizontal wheelchair support surface, such as a floor. In instances where a wheelchair is used to transport barefooted persons, footrests may also become a haven for bacteria, thereby rendering them unsanitary to grasp and move by hand.

Manual rotation of footrest platforms can also result in undesired movement of the entire wheelchair if the chair is supported by a caregiver absent setting a brake. For instance, caregivers and medical professionals often have difficulty maneuvering the wheelchair with the typical pair of hand grips requiring two hands to operate effectively. Often, caregivers and medical professionals must also carry along a walking cane for use by the wheelchair occupant when out of the chair. The cane is typically carried separately from the chair making maneuvering the wheelchair even more difficult.

Therefore, there is a need for wheelchair systems that remove some of the encumbrances to wheelchair use including a system for moving the footrests out of the way more easily and a system for storing a cane and also providing a handle to allow one-handed wheelchair maneuvering.

SUMMARY OF THE INVENTION

The present invention relates to wheelchair convenience systems and methods for using the same which make getting into and out of a wheelchair easier and the maneuvering of the wheelchair more manageable.

An embodiment of a wheelchair footrest assembly according to the present invention includes a frame and a footrest platform that it rotatably supported on the frame. The footrest platform is operable between a first, preferably substantially vertical, position and a second, preferably substantially horizontal, position. A lever is operatively connected to the frame by a pivot member, and a linkage, such as a flexible cable, extends from the lever to the footrest platform. A bias member, such as a torsion spring, is in forcible contact with the frame and the footrest platform. In this way, the bias member biases the footrest platform toward the first position and movement of the lever about the pivot member moves the footrest platform from the first position towards the second position through the linkage connection.

According to an aspect of an embodiment of a footrest assembly according to the present invention, where the bias member is a torsion spring, it includes a first leg in contact with the footrest platform and a second leg in contact with the frame.

According to another aspect of an embodiment of a footrest assembly according to the present invention the frame is configured to be manually removably attached to a wheelchair. To achieve this, the frame may support a first flange with a first hole and a second flange with a second hole, the second hole coaxially aligned with the first hole. A spring-loaded attachment member may be configured to engage with a catch on a leg of the wheelchair.

According to yet another aspect of an embodiment of a footrest assembly according to the present invention, the footrest platform is configured to receive and support a human foot of a wheelchair occupant when the platform is in the second position. The the bias member has a spring force sufficient to bias the footrest platform to the first position when the foot is not received on the footrest platform. The bias member spring force is overcome when the foot is received on the footrest platform, the received foot thereby maintaining the footrest platform in the second position without manipulation of the lever.

According to still another aspect of an embodiment of a footrest assembly according to the present invention, where the linkage is a flexible cable, tension applied to the cable causes the cable to slide against a frictional bearing surface defined by either or both of (a) a collar on the footrest platform, and (b) the frame.

The present invention relates also to a convenience system to be used with a wheelchair having spaced handlebars which may include handgrips. According to an aspect of an embodiment of a wheelchair convenience system according to the present invention the convenience system comprising includes a handlebar assembly including a walking cane extending between and including a first end portion and a second end portion, a first retainer, and a second retainer. The first retainer is configured to be removably attached to the first handlebar, such as at the first handgrip, and releasably retain one of the first end portion of the cane and the second end portion of the cane. The second retainer is configured to be removably attached to the second handlebar, such as at the second handgrip, and releasably retain the other of the first end portion of the cane and the second end portion of the cane. The first and second retainers may each include a clamp configured to be tightened about the first and second handgrips, respectively.

According to another aspect of an embodiment of a wheelchair convenience system according to the present invention, the first and second retainers may each comprise a first member pivotably connected to a second member, wherein the first member and second member are operable by a quick release mechanism from an open position to receive the cane and a closed position secured against the cane.

A method according to the present invention includes the step of providing a wheelchair having a first footrest assembly, which may be a prior footrest assembly or an assembly according to the present invention. The method further includes the step of providing a second wheelchair footrest assembly, the second footrest assembly being in accord to the present invention. The first footrest assembly is removed, and the second footrest assembly is installed on the wheelchair so as to replace the first footrest assembly.

According to an aspect of a method according to the present invention, the removal and/or installation steps may be performed manually and without the use of mechanical tools.

According to another aspect of a method according to the present invention, the method may further include the step of operating the lever on the second footrest assembly to move the footrest platform from the first position to the second position.

According to still another aspect of a method according to the present invention, if the wheelchair has a conventional arrangement of two spaced handlebars, the method may further include the step of securing a walking cane to both of the spaced handlebars. Additionally, the method may include the step of maneuvering the wheelchair using a single human hand applying force on the cane.

DETAILED DESCRIPTION

Although the disclosure hereof enables those skilled in the art to practice the invention, the embodiments described merely exemplify the invention which may be embodied in other ways. While the preferred embodiment has been described, the details may be changed without departing from the invention. It should be noted that like part numbers represent like parts among the various embodiments.

Figure 1:
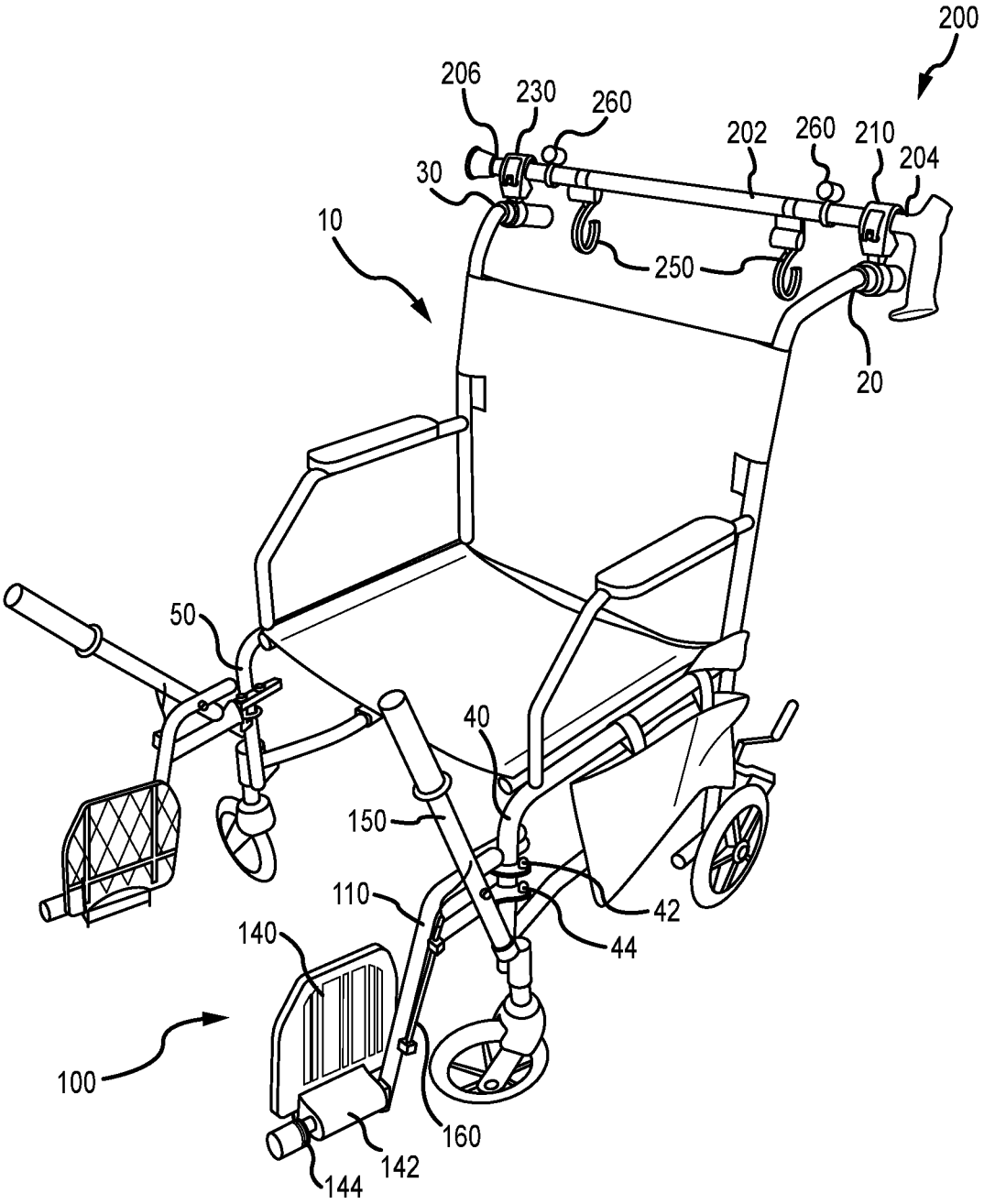
FIG. 1 is a perspective view of an exemplary embodiment of a wheelchair with wheelchair accessories according to the present invention.

FIG. 1 illustrates a wheelchair 10 incorporating exemplary embodiments of the systems according to the present invention, namely one or two footrest assemblies 100 and/or a handlebar assembly 200.

The wheelchair 10 may, like a conventional wheelchair, have spaced handle bars supporting a first handgrip 20 and a second handgrip 30, a first leg extension 40, and a second leg extension 50. For the sake of clarity and brevity, the footrest assembly 100 will be described with respect to only the first leg extension 40 as it should be understood that the first leg extension 40 and the second leg extension 50 are preferably mirror images of each other.

Figure 2:
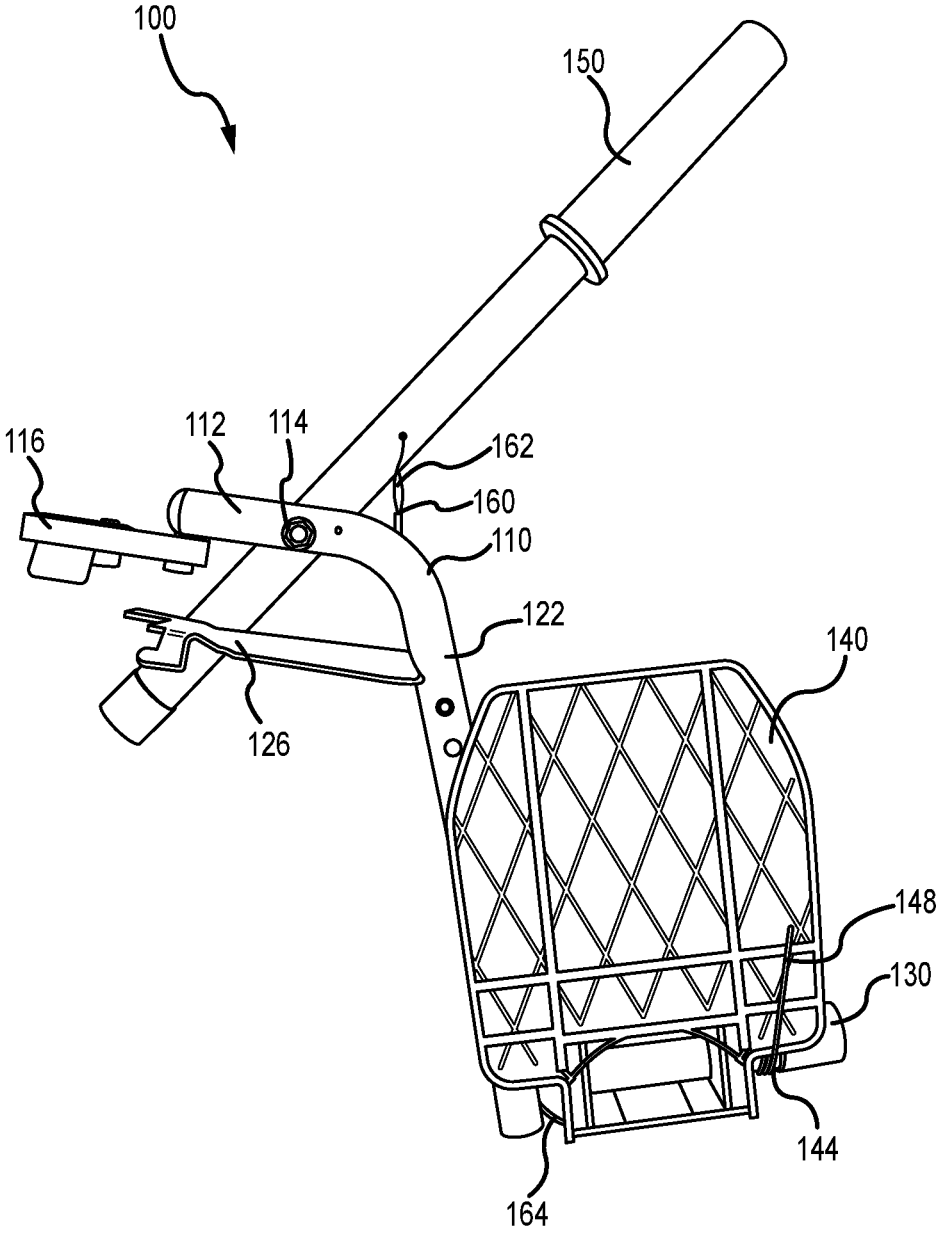
FIG. 2 is a side elevation view of a wheelchair footrest according to the present invention.
Figure 3:
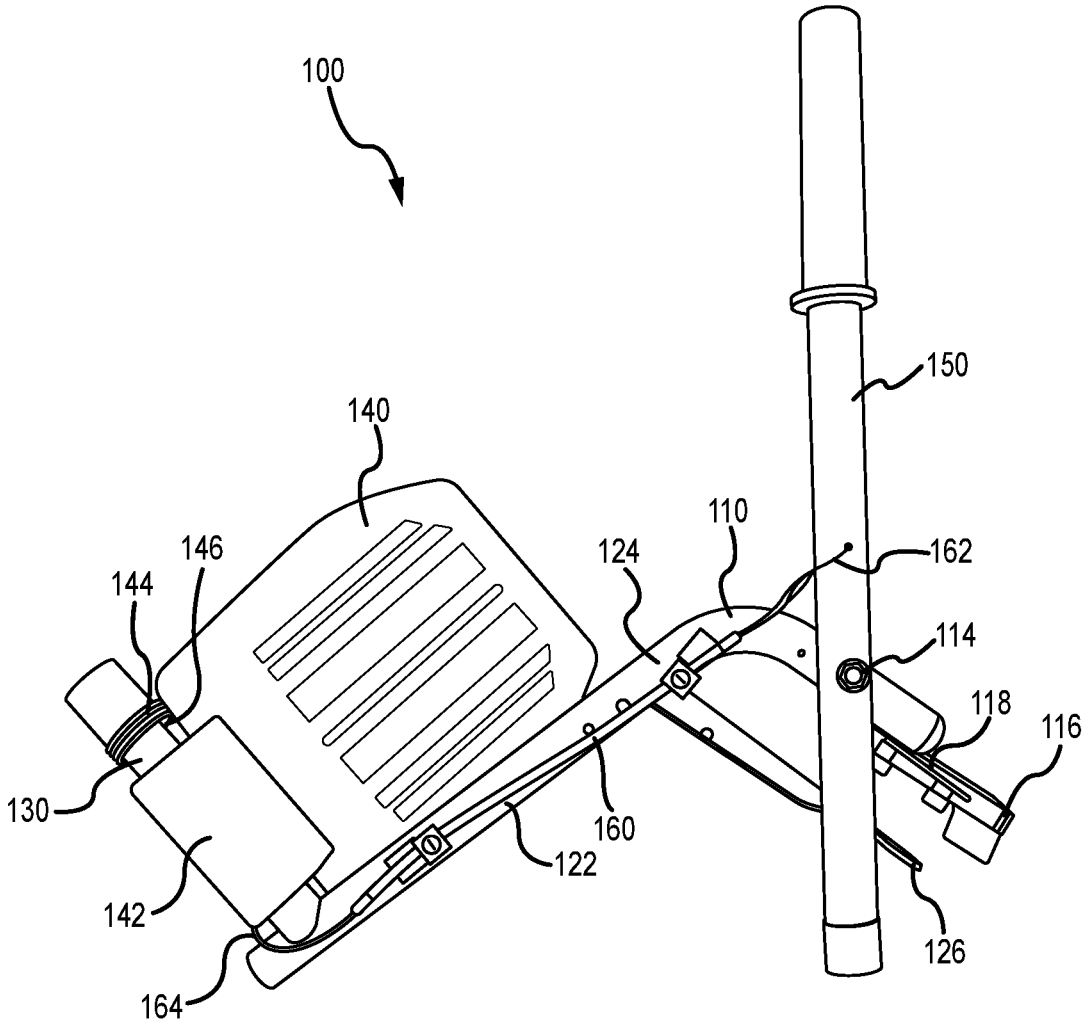
FIG. 3 is a side elevation view of the wheelchair footrest according to the present invention.
Figure 4:
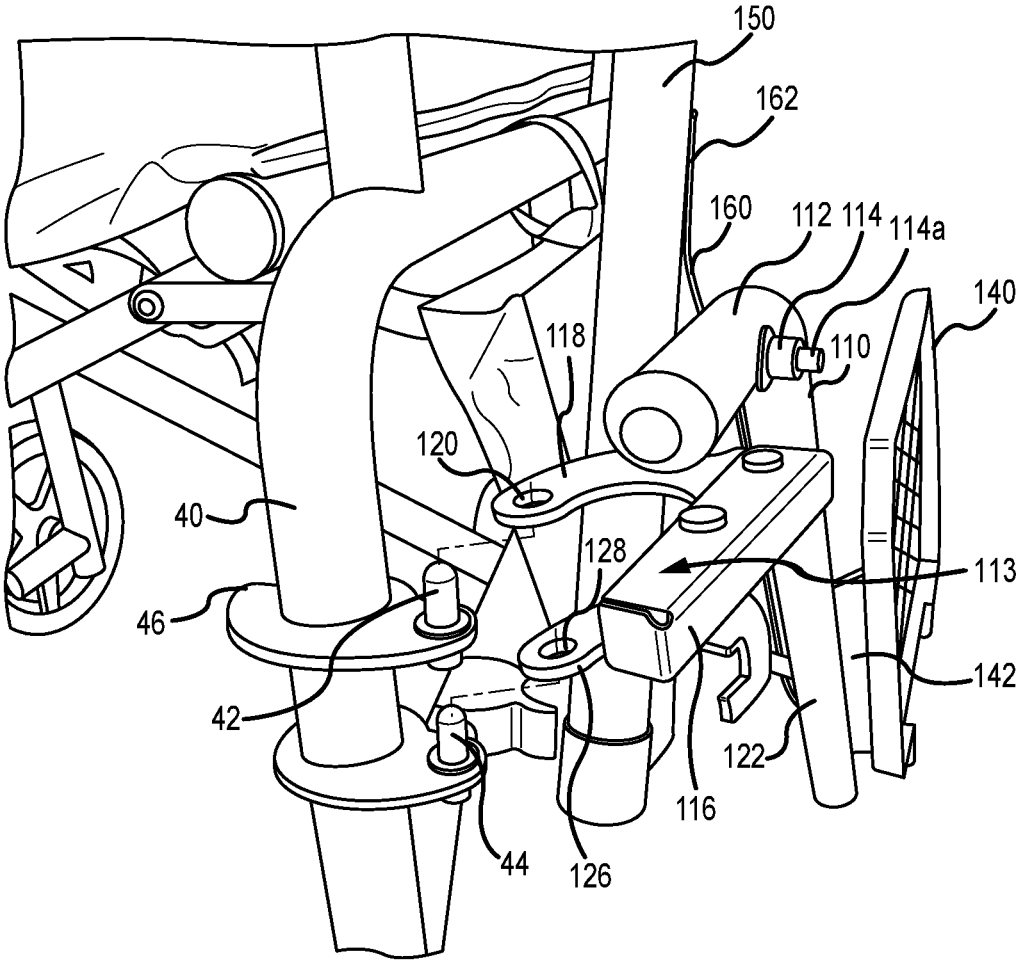
FIG. 4 is a perspective view of the mounting relationship between the wheelchair footrest and a wheelchair according to the present invention.

With reference also to FIGS. 2-4, the footrest assembly 100 preferably comprises a frame 110, a footrest platform 140, a bias member 144, a lever 150, and a linkage 160.

The frame 110 preferably has a proximal portion 112, a medial portion 122, and a distal portion 130. The proximal portion 112 preferably supports a mounting structure 113 to couple the frame 110 to the wheelchair leg extension 40. The proximal portion 112 also supports a pivot member 114, which allows rotational engagement of the lever 150 with respect to the frame 110. The pivot member 114 may comprise a pin 114*a* extending through the proximal portion 112. The mounting structure 113 includes an attachment clip 116, a first flange 118 with a first mounting hole 120, and a second flange 126 with a second mounting hole 128.

The medial portion 122 extends between the proximal portion 112 and distal portion 130 and provides a mounting surface 124 along which to slidably mount the linkage 160 which extends between the lever 150 and the footrest platform 140. The medial portion 122 also preferably supports a second flange 126 extending at least substantially parallel to the first flange 118. The second flange 126 may include the second mounting hole 128, which is preferably formed or disposed coaxially with the first mounting hole 120.

The distal portion 130 is preferably configured to be received within a collar 142 of the footrest platform 140. The collar 142 allows the footrest platform 140 to rotate about the distal portion 130 between a first, preferably default up position (see FIG. 7) and a second, preferably actuated down position (see FIG. 8).

The portions of the frame 110 may be formed integrally, as is shown between the proximal portion 112 and medial portion 122. Additionally or alternatively, the portions of the frame 110 may be secured to each other, such as by welding, adhesive, and/or mechanical fasteners.

Figure 7:
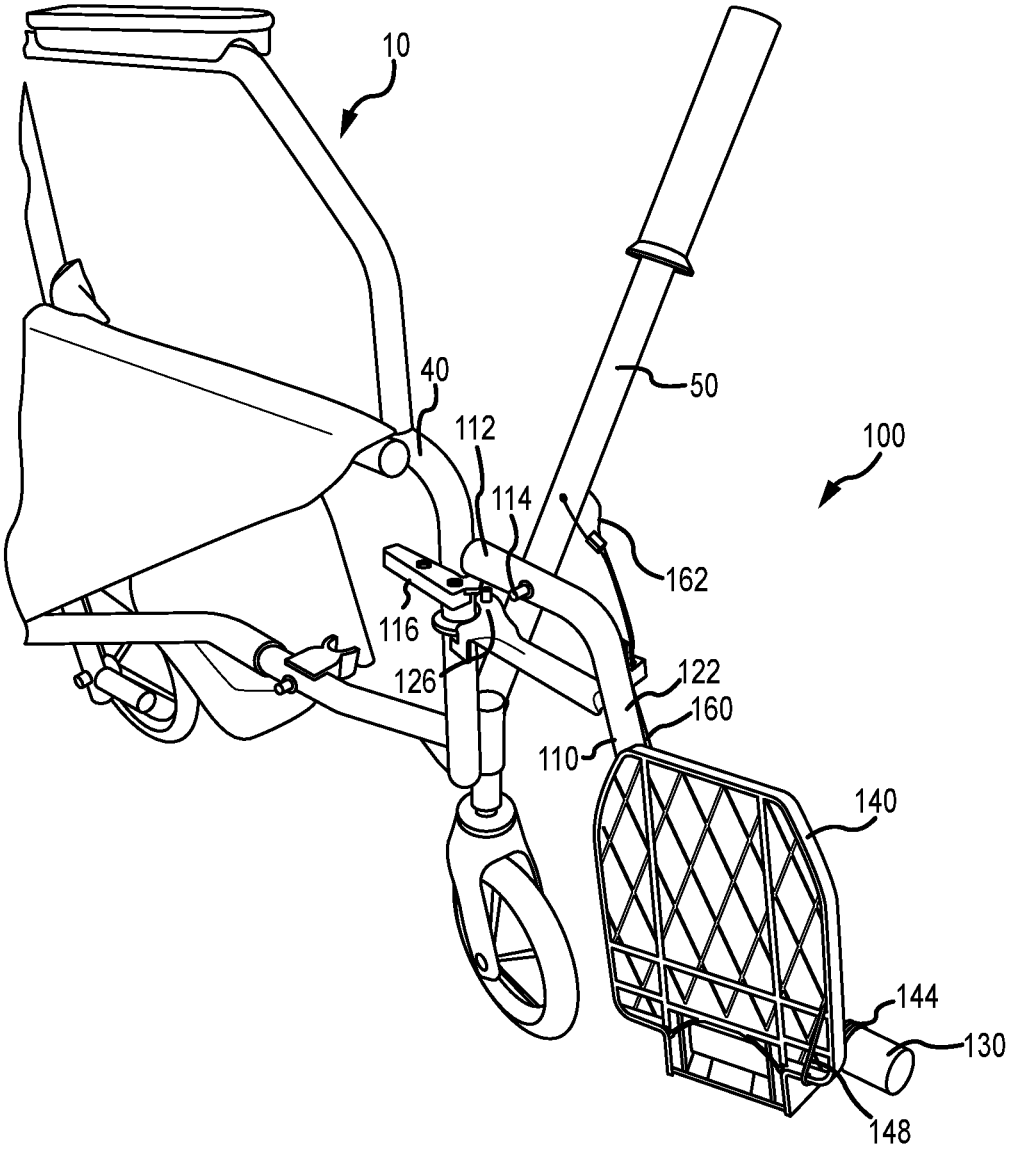
FIG. 7 is a perspective view of the wheelchair footrest according to the present invention.
Figure 8:
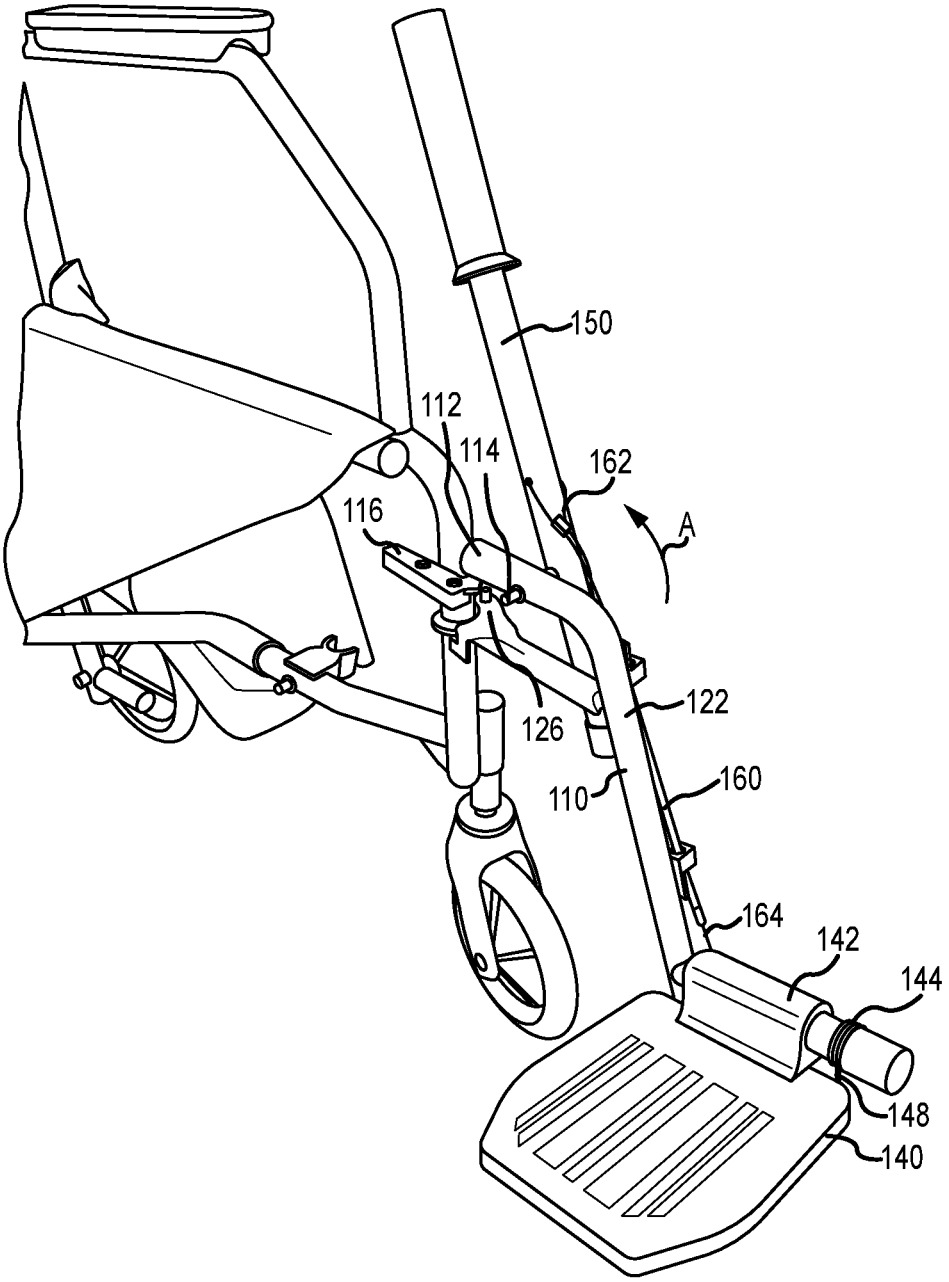
FIG. 8 is a perspective view of the wheelchair footrest according to the present invention.

The linkage 160 is preferably a flexible cable extending between a first end portion 162 and a second end portion 164. The first end portion 162 is secured to the lever 150 at a longitudinal position along the lever 150, and the section portion 164 is secured to the footrest platform 140. The cable 160 preferably extends in frictional contact, at least during operation, around an external bearing surface provided by either or both of the distal portion 130 and/or the collar 142. In this manner, when tension is applied to the cable 160, the footrest platform 140 pivots about the distal portion 130 from a substantially vertical position (as shown in FIG. 7) towards a substantially horizontal position (as shown in FIG. 8), as further described herein.

Figure 5:
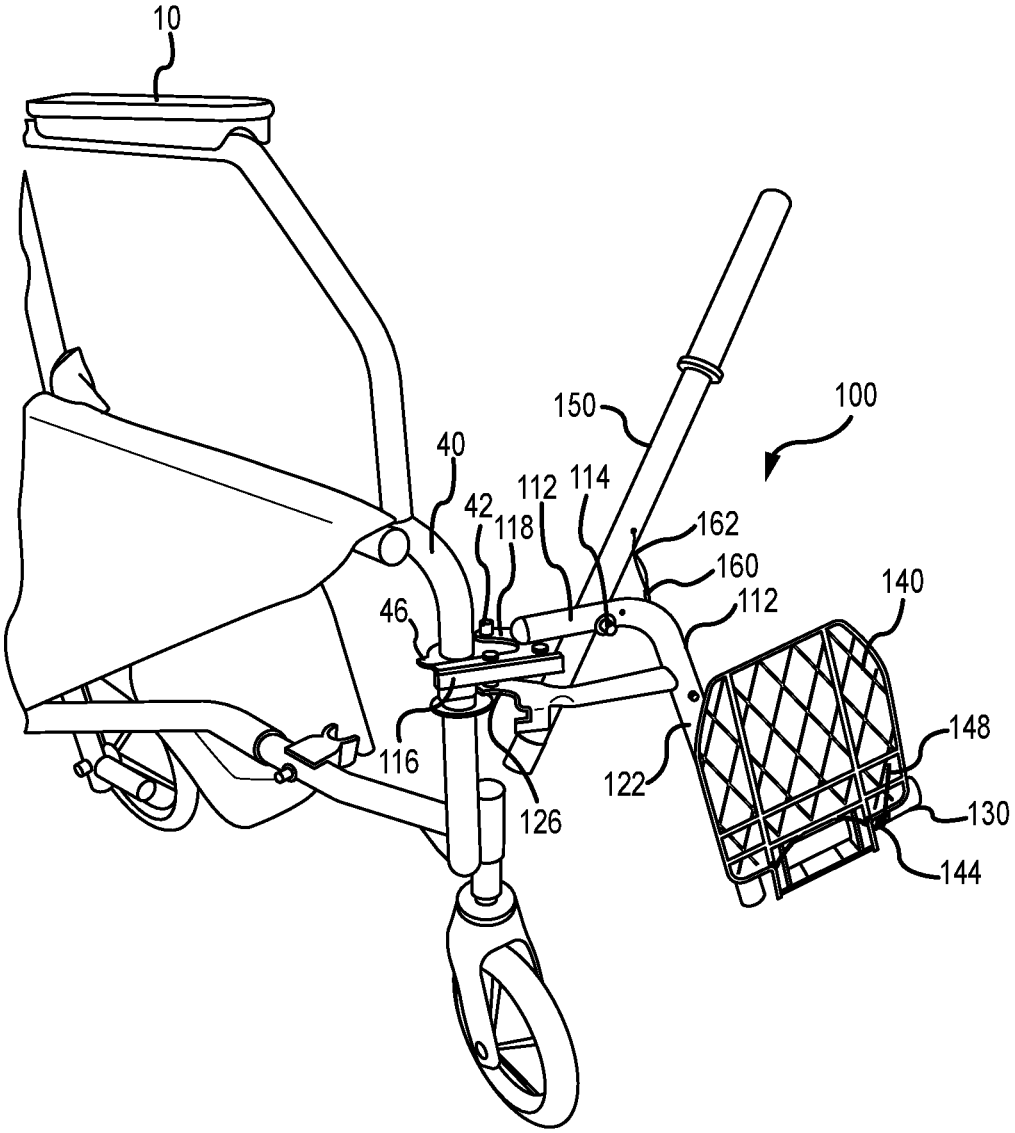
FIG. 5 is a perspective view of the wheelchair footrest according to the present invention.
Figure 6:
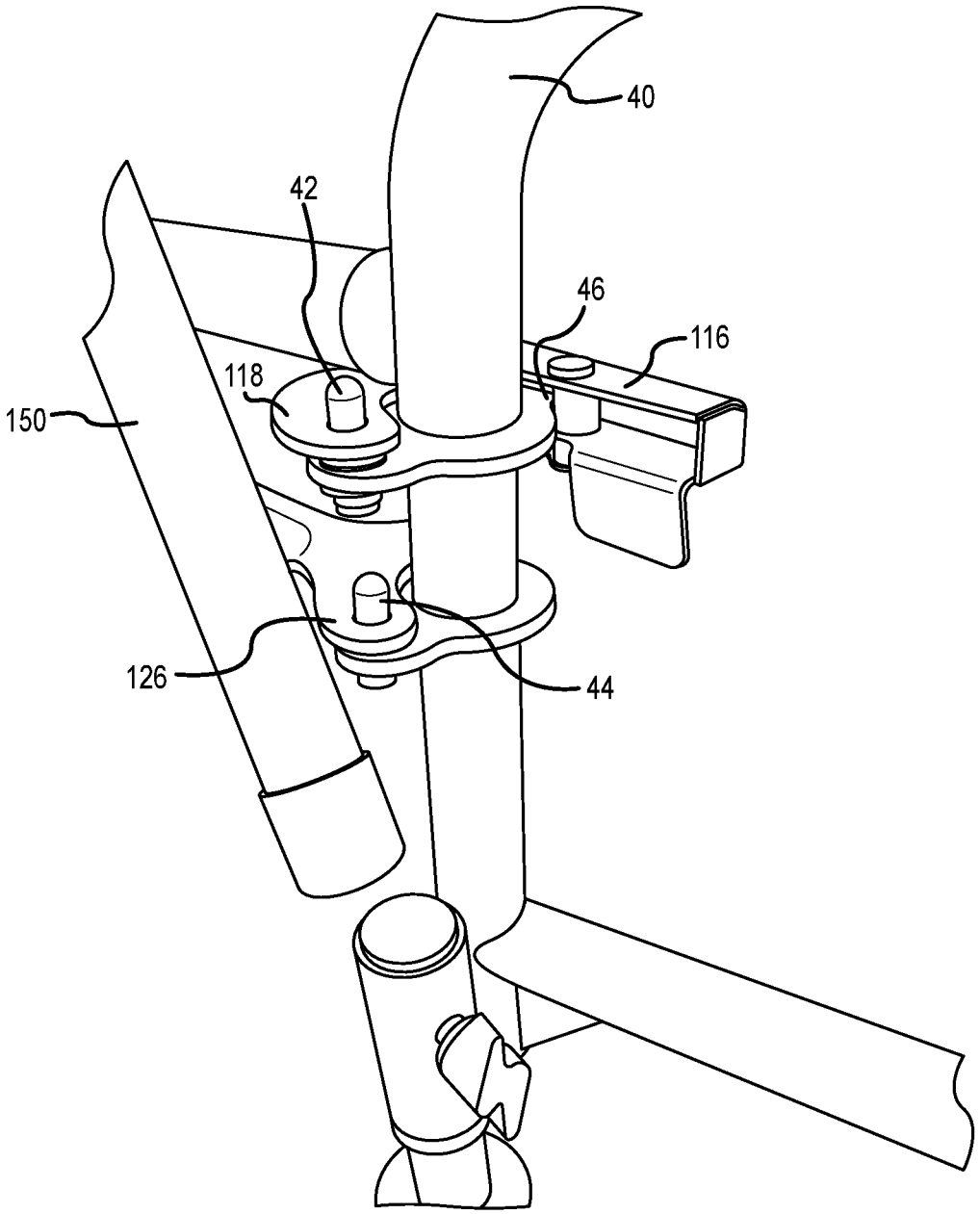
FIG. 6 is a perspective view of the mounting relationship between the wheelchair footrest and a wheelchair according to the present invention.

A quick release mechanism may be employed to allow for ease of mounting, such as removal and mounting by hand, manually, without the use of mechanical tools. Known quick release mechanisms exist, such as that shown and described in U.S. Pat. No. 4,722,572, issued to Sata, entitled Latch and Release Mechanism for Wheelchair Footrest, which is incorporated herein by reference in its entirety. As shown in FIGS. 4-6, the first wheelchair leg extension 40 preferably has a first pin 42, a second pin 44, and a catch member 46. The first leg extension 40 is configured to removably receive the footrest assembly 100 via interaction of the first and second pins 42,44 and the catch member 46 of the first leg extension 40 and the first and second holes 120,128 in the first and second flanges 118,126, respectively, and the attachment member 116 of the footrest assembly 100.

The first and second pins 42,44 are received within the first and second holes 120,128 of the first and second flanges 118,126 on the proximal portion 112 of the footrest assembly 100 (FIG. 4). The footrest assembly 100 is then pivoted about the pins 42 (FIG. 5) and the attachment member 116 is engaged with the catch member 46 of the first leg extension 40 (FIG. 6). Such quick release mechanism may be provided on a conventional wheelchair utilizing conventional footrest assemblies, which are to be replaced by footrest assemblies according to the present invention. Thus, it is preferable that conventional footrest assemblies may be removed by hand and/or the inventive assemblies installed by hand, without the need for tools.

Looking back to FIGS. 2 and 3, it is shown that the bias member 144 is preferably a torsion spring, whereby a first end segment or leg, 146 of the bias member 144 is engaged with the distal portion 130 of the frame 110 of the footrest assembly 100 and a second end segment or leg, 148 of the bias member 144 is engaged with the footrest platform 140.

Preferably, the bias member 144 biases the footrest platform 140 into the first, substantially vertical (e.g., up), position as shown in FIG. 7. As can be seen, the linkage 160 has some slack at least at the first end portion 162.

FIG. 8 illustrates that movement of the lever 150 about the pivot member 114 in direction depicted by arrow A moves the footrest platform 140 from the first position to the second position. Here it can be seen that the slack in the linkage 160 as shown in FIG. 7 is removed and the linkage 160 is taut from the tension created by moving the lever 150 in the direction of arrow A.

Retaining the lever 150 in the second position allows an occupant of the wheelchair 10 to place his or her foot (not shown) on the footrest platform 140. Preferably, the weight of the user's foot overcomes the spring force of the bias member 144 and the footrest platform 140 is retained in the second, substantially horizontal (e.g., down), position by the weight of the user's foot.

Handlebar Assembly

Figure 9:
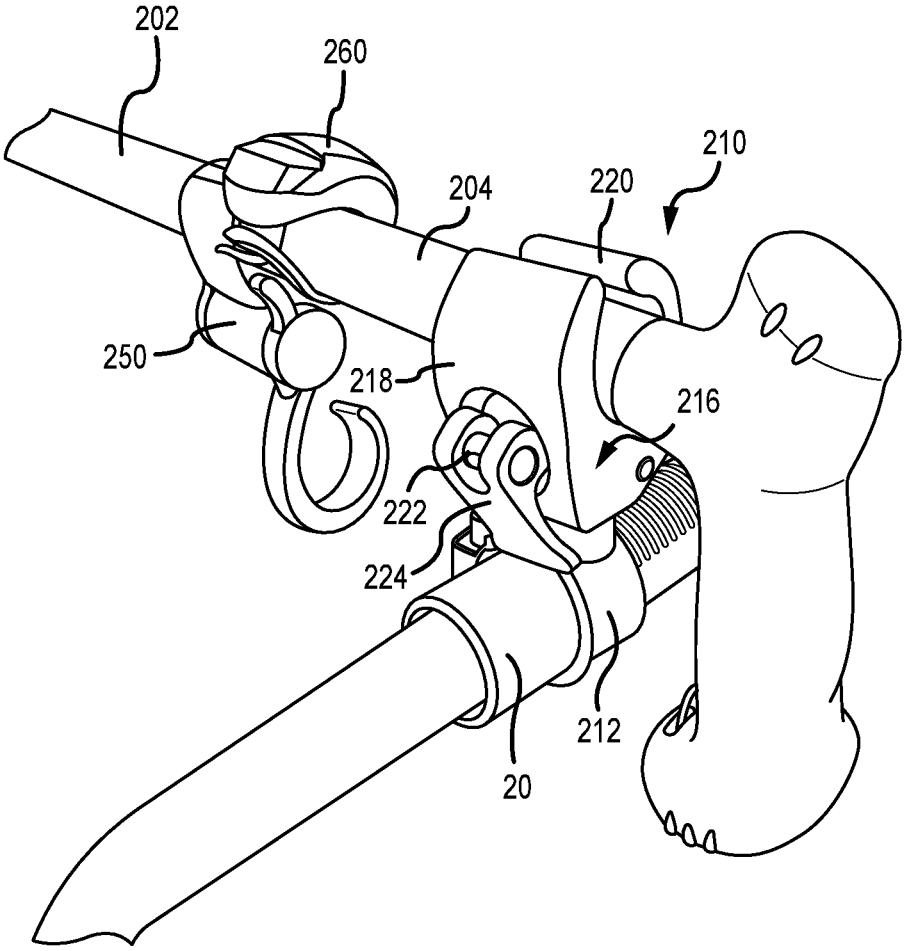
FIG. 9 is a perspective view of a handle attachment according to the present invention.
Figure 10:
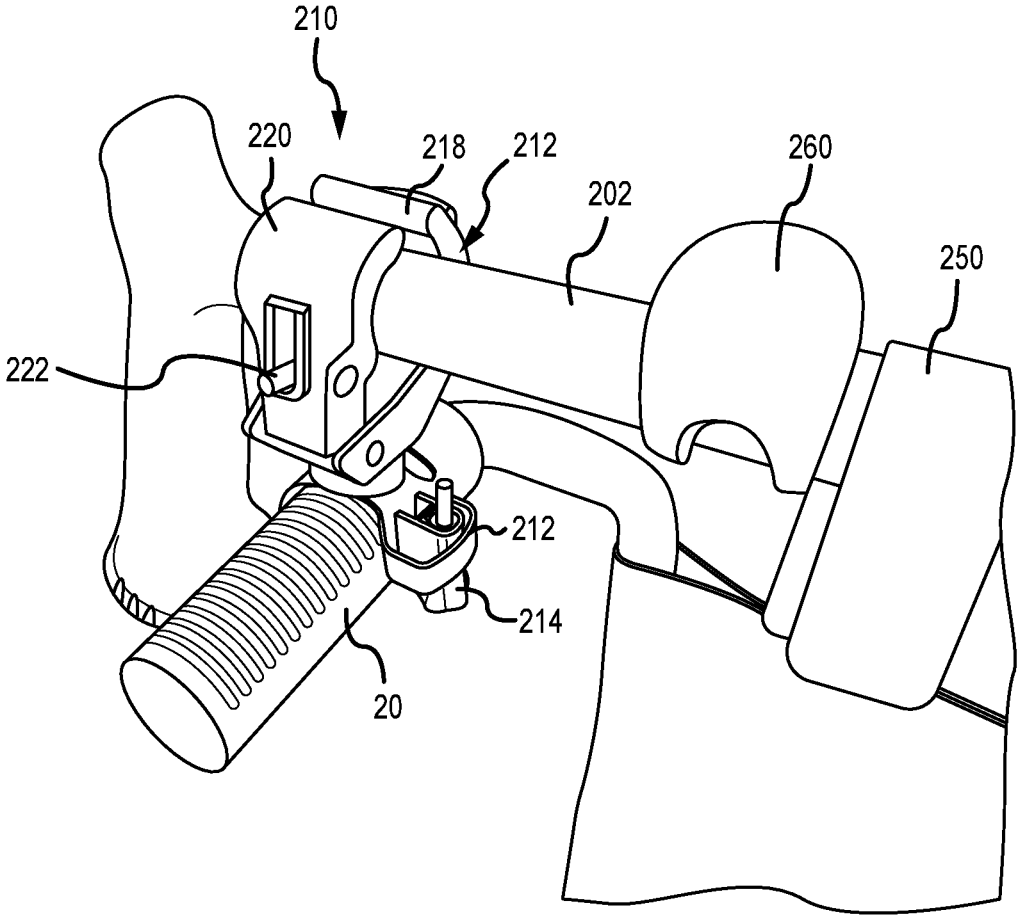
FIG. 10 is a perspective view of the handle attachment according to the present invention.

With reference to FIGS. 1, 9 and 10, the handlebar assembly 200 preferably comprises a cane 202, a first retainer 210, and a second retainer 230. The cane 202 has a first end portion 204 and a second end portion 206 (shown in FIG. 1). For ease of explanation, discussion pertaining to the releasably securing of the handlebar assembly 200 to the wheelchair 10 will be directed to the attachment of the first retainer 210 to the first handgrip 20 and the first end portion 204 of the cane 202 to the first retainer 210, but it should be understood that the second retainer 230 and the second end portion 206 of the cane 202 is preferably retained in a substantially similar or identical manner to the second handgrip 30.

The first retainer 210 preferably comprises a clamp 212 and a quick release mechanism 216 comprising a first member 218 extending from the clamp 212 and a second member 220 pivotably attached to the first member 218. The clamp 212 is preferably positioned around the first handgrip 20 and fastened thereto by a fastener 214 which tightens the clamp 212 around the first handgrip 20. The first and second members 218,220 are preferably configured to have profiles which follow the curvature of the cane 202.

As shown in FIG. 9, the quick release mechanism 216 has a screw-type fastener 222 with a lobe latch 224 preferably extending between the first and second members 218,220. The screw-type fastener 222 is preferably tightened by turning the lobe latch 224, bringing the second member 220 closer to the first member 218, and a final pressure is exerted onto the retained cane 202 by engaging the lobe latch 224. It should be noted that other mechanisms for releasably retaining the cane 202 to the first and second handgrips 20,30 are contemplated and the disclosure of the preferred first retainer 210 should not be construed as limiting.

When the cane 202 is retained, a care provider (not shown) can maneuver the wheelchair 10 one-handed by placing her hand anywhere along the cane 202 in the area between the first and second handgrips 20,30.

Removing the cane 202 from the first retainer 210 is performed by disengaging the lobe latch 224 and loosening the screw-type fastener 222 to allow the cane 202 to be released from between the first and second members 218, 220 of the first retainer 210.

When not retained within the retainer 210, the cane 202 may be used to aid the wheelchair occupant in walking when not using the wheelchair 10.

Bag hooks 250 and lights 260 may be attached to the cane 202 as shown in FIGS. 1 and 9. The bag hooks 250 allow a user to attach bags such as shopping bags or the like to the cane 202.

The lights 260 may be used to provide visibility in low light situations when the cane 202 is retained within the first retainer 210 or when being used as a cane when removed from the first retainer 210.

The foregoing is considered as illustrative only of the principles of the invention. Furthermore, because numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A wheelchair footrest assembly comprising:

a frame;

a footrest platform rotatably attached to the frame and operable between a first position and a second position;

a lever operatively connected to the frame by a pivot member;

a linkage extending from the lever to the footrest platform; and a bias member in forcible contact with the frame and the footrest platform, the bias member comprising a torsion spring having a first leg in contact with the footrest platform and a second leg in contact with the frame;

whereby the bias member biases the footrest platform toward the first position and movement of the lever about the pivot member moves the footrest platform from the first position towards the second position through the linkage connection.

2. The wheelchair footrest assembly of claim 1, wherein the frame is configured to be manually removably attached to a wheelchair.

3. The wheelchair footrest assembly of claim 2, wherein the frame further comprises:

a first flange with a first hole;

a second flange with a second hole, the second hole coaxially aligned with the first hole; and a spring-loaded attachment member configured to engage with a catch on a leg of the wheelchair.

4. The wheelchair footrest assembly of claim 1, wherein the first position is substantially vertical and the second position is substantially horizontal.

5. The wheelchair footrest assembly of claim 4, wherein the footrest platform is configured to receive and support a human foot of a wheelchair occupant when the platform is in the second position, wherein the bias member has a spring force sufficient to bias the footrest platform to the first position when the foot is not received on the footrest platform, and wherein the bias member spring force is overcome when the foot is received on the footrest platform, the received foot thereby maintaining the footrest platform in the second position without manipulation of the lever.

6. The wheelchair footrest assembly of claim 1, wherein the linkage is a flexible cable.

7. The wheelchair footrest assembly of claim 6, whereby tension applied to the cable causes the cable to slide against a frictional bearing surface defined by at least one of:

a collar on the footrest platform, and the frame.

8. A method comprising the steps of:

providing a wheelchair having a first footrest assembly;

providing a second footrest assembly, the second footrest assembly according to claim 1;

removing the first footrest assembly from the wheelchair; and installing the second footrest assembly on the wheelchair so as to replace the first footrest assembly.

9. The method of claim 8, wherein the removing step is performed manually, without the use of tools.

10. The method of claim 9, wherein the installing step is performed manually, without the use of tools.

11. The method of claim 8, wherein the installing step is performed manually, without the use of tools.

12. The method of claim 8, further comprising the step of operating the lever of the second footrest assembly to move the footrest platform from the first position to the second position.

13. The method of claim 8, the wheelchair further comprising first and second spaced handlebars, the method comprising the step of:

securing a walking cane to both of the spaced handlebars.

14. The method of claim 13, further comprising the step of maneuvering the wheelchair using a single human hand applying force on the cane.

* * * * *